United States Patent [19]

Modic

[11] Patent Number: 4,618,522

[45] Date of Patent: Oct. 21, 1986

[54] ORGANOSILOXANE FABRIC COATING COMPOSITIONS

[75] Inventor: Frank J. Modic, Scotia, N.Y.

[73] Assignee: General Electric Company, Waterford, N.Y.

[21] Appl. No.: 562,800

[22] Filed: Dec. 19, 1983

[51] Int. Cl.[4] ..... B32B 5/02

[52] U.S. Cl. ..... 428/145; 427/387; 427/393.3; 427/393.4; 427/412; 428/141; 428/143; 428/240; 428/241; 428/242; 428/244; 428/245; 428/251; 428/252; 428/253; 428/266; 428/273; 428/283; 428/285; 428/447; 428/448; 428/921

[58] Field of Search ..... 428/240, 244, 245, 266, 428/251, 268, 273, 446, 447, 283, 285, 241, 242, 921; 427/387, 393.3, 393.4, 412

[56] References Cited

U.S. PATENT DOCUMENTS

| | | | |
|---|---|---|---|
| 2,684,349 | 7/1954 | Whelton | 260/37 |
| 3,284,406 | 11/1966 | Nelson | 260/46.5 |
| 3,436,366 | 4/1969 | Modic | 260/37 |
| 3,457,214 | 7/1969 | Modic | 260/37 |
| 3,527,655 | 9/1970 | Ballard | 117/72 |
| 3,639,155 | 2/1972 | Harlein et al. | 117/138.8 |
| 4,297,265 | 10/1981 | Olsen | 260/33.65 B |
| 4,300,532 | 11/1981 | Olsen | 126/417 |
| 4,308,309 | 12/1981 | Frosch | 428/241 |
| 4,358,558 | 11/1982 | Shimizu | 524/847 |
| 4,370,376 | 1/1983 | Gangal et al. | 428/241 |
| 4,419,402 | 12/1983 | Gutek | 428/266 |
| 4,472,470 | 9/1984 | Modic | 428/145 |
| 4,500,584 | 2/1985 | Modic | 428/145 |

OTHER PUBLICATIONS

Encyclopedia of Chemical Technology, vol. 16, Kirk-Othmer (John Wiley and Sons, 1981), pp. 72-124.

Encyclopedia of Chemical Technology, vol. 13, Kirk-Othmer (John Wiley and Sons, 1981), pp. 968-977.

*Primary Examiner*—James J. Bell

*Attorney, Agent, or Firm*—Gary L. Loser

[57] ABSTRACT

A method for imparting improved tear strength and improved flame retardance to a base fabric material comprising applying to at least one side of said base fabric material a base silicone coating composition containing an amount of non-abrasive filler effective for imparting tear strength and flame retardance.

22 Claims, No Drawings

ORGANOSILOXANE FABRIC COATING COMPOSITIONS

BACKGROUND OF THE INVENTION

Reference is made to copending applications Ser. No. 511,704 U.S. Pat. No. 4,500,584 and Ser. No. 511,705 U.S. Pat. No. 4,472,470 of Frank J. Modic, both of which were filed July 7, 1983, and are assigned to the same assignee as the present invention.

The present invention relates to coated fabrics having improved strength and improved flame retardance. More particularly, the present invention relates to a method for improving the strength and flame retardance of silicone coated glass cloth by incorporating non-abrasive fillers such as calcium carbonate, hydrated alumina and the like into the elastomeric silicone coating.

The discovery that Teflon ® coated fiberglass could be utilized as a noncombustible, durable roof structure has initiated a transformation from simplistic, temporary air-supported structures to one with evergrowing potential. The impetus for the development of such fabric membrane structures was to provide roofing for large sports facilities. This led to other roofing uses such as for department stores, shopping malls, schools, exhibition buildings, industrial structures and the like. While the Teflon-coated fiberglass system has many desirable features such as durability and dirt resistance, it suffers from the major deficiency that light (solar) transmission is limited to approximately 10 to 15% due to the opaqueness of Teflon.

Modic, in copending patent application, Ser. Nos. 511,704 and 511,705 filed July 7, 1983, provided roofing fabric membrane structures which overcome the light transmission problem of the Teflon-coated fiberglass system by utilizing a transparent or translucent base coating and a transparent or translucent dirt resistant coating. Modic further taught that a finely divided inorganic filler could optionally be included in the silicone coatings in order to adjust the translucency of the coated fiberglass fabric. The extent to which light transmission is reduced is determined by the quantity of filler utilized, i.e. more filler reduces the amount of light which passes through to the interior of the building or structure. Modic also taught that since the function of the finely divided filler is not to reinforce the composition, reinforcing fillers are generally not employed.

It has recently been found that the tear strength of the coated fabric was about the same or less than that of the original uncoated fabric when ground quartz such as Minusil ® was employed as a filler on a fiberglass cloth. Quite unexpectedly, the present applicant has discovered that when certain non-abrasive fillers such as calcium carbonate and hydrated alumina are added to the base silicone coating composition, the tear strength of the coated fabric significantly increases. Moreover, the inclusion of such non-abrasive fillers in the silicone coatings surprisingly improves the flame retardance or flame resistance of the coated fabric.

SUMMARY OF THE INVENTION

It is one object of the present invention to provide fabric membrane structures which exhibit improved tear strength and flame retardance.

Another object of the present invention is to provide a method for improving tear strength and flame retardance of silicone coated fabric membrane structures.

In accordance with the present invention there is provided a fabric membrane structure comprising:

(a) a base fabric material;

(b) a base silicone coating composition containing an amount of a non-abrasive filler effective for imparting improved tear strength and improved flame retardance to the said fabric membrane structure, and (c) optionally, a coating composition which is resistant to dirt pickup.

In accordance with another aspect of the present invention there is provided a method for imparting improved tear strength and flame retardance to fabric membrane structures comprising:

(a) applying to at least one side of a base fabric material a base silicone coating composition containing an amount of non-abrasive filler effective for imparting improved tear strength and improved flame resistance to said fabric membrane structure, and (b) optionally, applying to at least one side of said base fabric material coated with said base silicone coating composition, a coating composition which is resistant to dirt pickup.

DESCRIPTION OF THE INVENTION

A preferred embodiment of the present invention provides a roofing fabric membrane structure having improved tear strength and improved flame retardancy comprising:

(a) a base fabric material;

(b) a silicone base coating composition containing an amount of non-abrasive filler effective for imparting improved tear strength and improved flame retardance to said roofing fabric membrane structure, and (c) optionally, a coating composition which is resistant to dirt pickup.

In another aspect of the present invention there is provided a method for imparting improved tear strength and flame retardance to roofing fabric membrane structures comprising:

(a) applying to at least one side of a base fabric material a base silicone coating composition containing an amount of non-abrasive filler effective for imparting improved tear strength and improved flame resistance to said roofing fabric membrane structure, and (b) optionally, applying to at least one side of said base fabric material coated with said silicone base coating composition a coating composition which is resistant to dirt pickup.

The base fabric material can be any suitable composition. It may be made from a natural fiber such as cotton, a synthetic fiber such as polyester, nylon or glass fabric, or mixtures of such fibers, depending on the properties which are desired for the base fabric. Cotton constructions are easily dyed, absorb moisture and withstand high temperatures without damage. Polyester produces fibers that are smooth, crisp and resilient, and since moisture does not penetrate polyester, it does not affect the size or shape of the fiber. Nylon is the strongest of the commonly used fibers and it is both elastic and resilient so that articles made with nylon will return to their original shape. Nylon fibers are smooth, very non-absorbent and will not soil easily. Glass fibers offer very low elongation and very high strength and hence are particularly useful for roofing fabric membrane structures.

The base fabric material construction can be of any suitable type such as woven, knitted or nonwoven. Woven fabrics have three basic constructions: the plain weave, the twill weave and the satin weave. The plain weave is by far the strongest because it has the tightest interlacing of fibers and, accordingly, is used most often. Woven nylon or heavy cotton are typically utilized for making tarpaulin substrates and the like. Knitted fabrics are used where moderate strength and considerable elongation are required. Of course, when the polymeric base coating, discussed in greater detail hereinbelow, is put on such a knit fabric, the stretch properties are somewhat reduced.

Nonwoven textile fabrics are porous, textile-like materials composed primarily of fibers and are manufactured by processes other than spinning, weaving, knitting or knotting. A few basic elements can be varied and controlled to produce a great range of nonwoven fabric materials. These include the fibers, including chemical types and physical variations; the web and the average geometric arrangement of its fibers as predetermined by its method of forming and subsequent processing; the bonding of the fibers within the web and reinforcements. In practice, each element can be varied and, thus, can exert a powerful influence, alone and in combination, on the final fabric properties. For an excellent discussion of nonwoven textile fabrics the reader is referred to the Encyclopedia of Chemical Technology, Vol. 16, Kirk-Othmer (John Wiley and Sons, 1981), pages 72–124.

Included within the definition of base fabric material are suitable laminated and reinforced plastics. Reinforced plastics are combinations of fibers and polymeric binders or matrices that form composite materials. Preferably, good adhesion exists between the fibers and the binder rather than merely a mechanical fit without adhesion. For further information, the reader is referred to the Encyclopedia of Chemical Technology, Vol. 13, Kirk-Othmer (John Wiley and Sons, 1981), pages 968–977.

Experience thus far has been that fiberglass fabric is particularly preferred as the base fabric material for the roofing fabric membrane structure of the present invention.

The base fabric material is coated with a base silicone coating composition. One example of a suitable base silicone polymer is described in U.S. Pat. No. 3,457,214 to Modic, assigned to the same asignee as the present invention and incorporated herein by reference. This patent teaches how to provide transparent silicone compositions having silica filler by employing phenyl-containing polymers to adjust the refractive index of the composition. This approach, however, is not preferred where transparency is critical since the refractive index of the polymer will change with temperature and thus the transparency of the filled silicone polymer will also change.

Accordingly, it is particularly preferred that resin reinforced, addition cure silicone compositions be utilized as the base coating composition as their transparency is not affected by temperature changes. Examples of particularly preferred silicone base coating compositions are described in U.S. Pat. Nos. 3,284,406 to Nelson and 3,436,366 to Modic, both of which are incorporated by reference into the instant disclosure. Other suitable base coating compositions will be obvious to those skilled in the art.

It should be noted that in the preferred base silicone coating compositions that the inclusion of a finely divided inorganic filler is optional as such filler is primarily useful as a means for controlling the transparency of the base polymer. In contrast to such teaching, the present applicant has surprisingly found that by adding an effective amount of non-abrasive filler such as calcium carbonate or hydrated alumina, the tear strength of the base fabric material as well as the flame retardance or resistance is dramatically improved. While calcium carbonate and hydrated alumina are the most preferred non-abrasive fillers within the scope of the present invention, other suitable non-abrasive fillers include fumed silica, aluminum silicate, potassium titanate, zirconium silicate, carbon black, zinc oxide, titanium dioxide, ferric oxide, silica aerogel, precipitated silica, calcium silicate, chromic oxide, cadmium sulfide, lithopone talc, magnesium oxide and graphite.

In order to obtain improved tear strength and flame resistance in accordance with the present invention it is critical that the amount of non-abrasive filler included in the base silicone coating be effective for providing such results. In general, an effective amount of non-abrasive filler ranges from as little as 5 parts filler per 100 parts polymer in the base coating composition to as much as 300 or more parts filler per 100 parts polymer in the base coating composition. More preferably, there are from 20 to 100 parts non-abrasive filler per 100 parts silicone polymer and most preferably there are from 30 to 50 parts non-abrasive filler per 100 parts diorganopolysiloxane in the base polymer.

It should be noted that when reinforcing fillers such as fumed silica or precipitated silica are utilized as the non-abrasive filler the resulting base silicone coating composition has an undesirably high viscosity. This problem, however, can easily be avoided by diluting the base silicone coating in a suitable solvent, for example, hexane, heptane, cyclohexane, cycloheptane, cyclohexene, benzene, toluene or xylene.

Methods of preparing suitable silicone base coating compositions are well known to those skilled in the art. Additionally, the methods for preparing the aforementioned base coating compositions of Modic and Nelson are described in their respective patents. Generally the base coating compositions of the present invention can be prepared merely by mixing the various components together in any desired fashion. It is often most convenient to prepare the preferred compositions in two separate portions or packages which are combined at the time the compositions are to be converted to the solid, cured, elastic state. In the case of the two package formulation it is convenient to include in the first package the vinyl chainstopped polysiloxane, the organopolysiloxane copolymer, the platinum catalyst and some or all of the finely divided, non-abrasive filler. The second package normally contains as its sole ingredient the organohydrogenpolysiloxane, but as a matter of convenience the second package can also contain a portion of the vinyl chainstopped polysiloxane and a portion of the non-abrasive filler. Typically the distribution of the components between the two packages is such that from 0.1 to 1 part by weight of the second package is employed per 1 part by weight of the first package.

When the two package system is employed the two components are merely mixed in a suitable fashion and the resulting silicone composition applied to the base fabric material. Various methods, such as spraying, dipping, brushing and roll coating are recognized methods for applying such silicone compositions to a substrate, in this case the base fabric material.

Of course, the base silicone coating composition does not necessarily have to be translucent, although this is one of the primary advantages of employing a silicone base coating composition. As Modic points out in his copending patent applications, attorney dockets Ser. No. 511,704 and Ser. No. 511,705, both of which were filed on July 7, 1983, and are assigned to the same assignee as the present invention, one problem with translucent silicone coated fabric membrane structures is that they pick up dust or dirt upon exposure to the atmosphere. Accordingly, in those instances where it is important to have a translucent roofing fabric membrane structure it is desirable to apply a transparent or translucent dirt resistant coating over the base silicone coating composition.

Preferably the dirt resistant coating is a silicone composition so that it is compatible with the base silicone coating composition. One example of a suitable dirt resistant silicone coating composition is that disclosed by Modic, application Ser. No. 511,705, which comprises (1) a liquid vinyl chainstopped polysiloxane having the formula

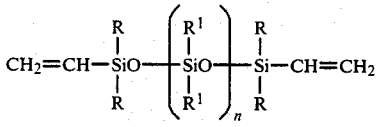

where R and $R^1$ are monovalent hydrocarbon radicals free of aliphatic unsaturation with at least 50 mole percent of the $R^1$ groups being methyl, and where n has a value sufficient to provide a viscosity up to 500 centipoise at 25° C.;

(2) a resinous organopolysiloxane copolymer comprising $(R^2)_3SiO_{0.5}$ units and $SiO_2$ units, where $R^2$ is selected from the group consisting of vinyl radicals and monovalent hydrocarbon radicals free of aliphatic unsaturation, where the ratio of $(R^2)_3SiO_{0.5}$ units to $SiO_2$ units is from about 0.5:1 to about 1:1, and where from about 1.5 to about 10 mole percent of the silicon atoms contain silicon-bonded vinyl groups;

(3) optionally, a finely divided inorganic filler;

(4) a platinum catalyst; and (5) a liquid organohydrogenpolysiloxane having the formula, $$(R)_a(H)_bSiO_{\frac{4-a-b}{2}}$$

sufficient to provide from about 0.5 to about 1.0 silicon-bonded hydrogen atoms per silicon-bonded vinyl group, where R is as previously defined, a has a value of from about 1.0 to about 2.1, b has a value of from about 0.1 to about 1.0, and the sum of a and b is from about 2.0 to about 2.7, there being at least two silicon-bonded hydrogen atoms per molecule.

In another embodiment of the invention in Modic, Ser. No. 511,705, the dirt resistant silicon coating composition comprises:

(1) a liquid vinyl chainstopped polysiloxane having the formula,

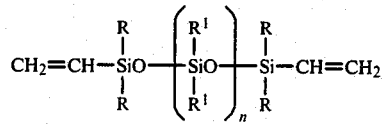

where R and $R^1$ are monovalent hydrocarbon radicals free of aliphatic unsaturation with at least 50 mole percent of the $R^1$ groups being methyl, and where n is sufficient to provide a viscosity up to 1,000 centipoise at 25° C.;

(2) a resinous organopolysiloxane copolymer comprising $(R^3)_3SiO_{0.5}$ units, $(R^3)_2SiO$ units and $SiO_2$ units, where $R^3$ is selected from the group consisting of vinyl radicals and monovalent hydrocarbon radicals free of aliphatic unsaturation, where from about 1.5 to about 10 mole percent of the silicon atoms contain silicon-bonded vinyl groups, and where the ratio of $(R^3)_3SiO_{0.5}$ units to $SiO_2$ units is from about 0.5:1 to about 1:1 and the ratio of $(R^3)_2SiO$ units to $SiO_2$ units may range up to 0.1:1

(3) optionally, a finely divided inorganic filler;

(4) a platinum catalyst; and (5) a liquid organohydrogenpolysiloxane having the formula, $$(R)_a(H)_bSiO_{\frac{4-a-b}{2}}$$

sufficient to provide from about 0.5 to about 1.0 silicon-bonded hydrogen atoms per silicon-bonded vinyl group, where R is as previously defined, a has a value of from about 1.0 to about 2.1, b has a value of from about 0.1 to about 1.0, and the sum of a and b is from about 2.0 to about 2.7, there being at least two silicon-bonded hydrogen atoms per molecule.

The dirt resistant coating described in Modic, Ser. No. 511,704, comprises (1) 100 parts of a liquid vinyl chainstopped polysiloxane of the formula

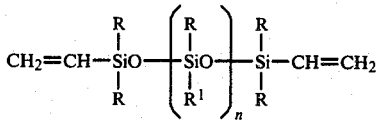

where R and $R^1$ are monovalent hydrocarbon radicals free of aliphatic unsaturation with at least 50 mole percent of the $R^1$ groups being methyl, and where n has a value sufficient to provide a viscosity up to about 2,000,000 centipoise at 25° C.;

(2) 100 to 200 parts of a resinous organopolysiloxane copolymer selected from the group consisting of:

(a) resinous organopolysiloxane copolymers comprising $(R^2)_3SiO_{0.5}$ units and $SiO_2$ units, where R is selected from the group consisting of vinyl radicals and monovalent hydrocarbon radicals free of aliphatic unsaturation, where the ratio of $(R^2)_3SiO_{0.5}$ units to $SiO_2$ units is from about 0.5:1 to about 1:1, and where from about 1.5 to about 10 mole percent of the silicon atoms contain silicon-bonded vinyl groups; and (b) resinous organopolysiloxane copolymer comprising $(R^3)_3SiO_{0.5}$ units, $(R^3)_2SiO$ units and $SiO_2$ units, where $R^3$ is selected from the group consisting of vinyl radicals and monovalent hydrocarbon radicals free of aliphatic unsaturation, where from about 1.5 to about 10 mole percent of the silicon atoms contain silicon-bonded vinyl groups, and where the ratio of $(R^3)_3SiO_{0.5}$ units to $SiO_2$ units is from about 0.5:1 to about 1:1 and the ratio of $(R^3)_2SiO$ units to $SiO_2$ units may range up to 0.1:1;

(3) optionally, a finely divided inorganic filler;

(4) a platinum catalyst; and (5) a liquid organohydrogenpolysiloxane having the formula, $$(R)_a(H)_bSiO_{\frac{4-a-b}{2}}$$

sufficient to provide from about 0.5 to about 1.0 silicon-bonded hydrogen atoms per silicon-bonded vinyl group, where R is as previously defined, a has a value of from about 1.0 to about 2.1, b has a value of from about 0.1 to about 1.0, and the sum of a and b is from about 2.0 to about 2.7, there being at least two silicon-bonded hydrogen atoms per molecule.

Another suitable dust-resistant coating is provided by the method of Shimizu et al., U.S. Pat. No. 4,395,443, which is also incorporated herein by reference. Briefly, Shimizu et al. provide a method of forming dust resistant films which comprises coating on the surface of a silicone elastomer a composition formed by dissolving (1) a condensation reaction product between (A) 100 parts by weight of a benzene-soluble polyorganosiloxane consisting essentially of $SiO_2$ units and $R_3^1SiO_{\frac{1}{2}}$ units, in which groups $R^1$, which may be the same or different, stand for a substituted or unsubstituted monovalent hydrocarbon group, wherein the amount of the $R_3^1SiO_{\frac{1}{2}}$ units is 0.4 to 1.0 mole per mole of the $SiO_2$ units and a reactive group selected from hydroxyl and alkoxy groups is bonded to the silicon atom in an amount of 0.0004 to 1 per silicon atom; and (B) 20 to 200 parts by weight of a silanol-terminated polydiorganosiloxane having a viscosity of 10,000 to 2,000,000 cSt as measured at 25° C., in (2) a mixed solvent comprising (a) a volatile organosilicon compound having a boiling point of 70° to 250° C. as measured under atmospheric pressure and being represented by the molecular formula:

$R_4^2Si$ $R_3^3SiO[R_2^4SiO]_mSiR_3^3$, $R^5Si[OSiR_3^6]_3$ or $[R_2^7SiO]_n$, in which $R^2$ through $R^7$, which may be the same or different, stand for a hydrogen atom or an alkyl group, m is 0 or a positive number and n is a positive number, and (b) a hydrocarbon solvent, the amount of the volatile organosilicon compound (a) being at least 5% by weight based on the total amount of the organosilicon compound (a) and the hydrocarbon solvent (b); and drying and curing the coated composition.

Other suitable dirt repellent coatings for use in the present invention will be obvious to the skilled artisan.

In the preferred embodiment it is contemplated that the roofing fabric membrane structure having improved tear strength and improved flame retardance will be most useful as a construction material in large, permanent air-supported or tension structures. However, owing to the versatility and effectiveness of the present invention there are many possible uses for the roofing fabric membrane in other areas of the roofing industry.

One potential application for this type of coating is in the single ply roofing market. For example, one side of the base fabric material could be coated in the factory. When the roofing was being applied some of the silicone coating could also be applied on top of the urethane on the roof. Thereafter the coated base fabric can be rolled with the uncoated side down thus sealing the system together without the need for an adhesive.

Another variation would be to apply the silicone-coated base fabric on top of urethane boards at the factory so that only sealing the seams between the boards would be required when the roofing is installed.

In order to more clearly illustrate the surprising results of the present invention, the following examples are provided by way of illustration and not by way of limitation.

EXAMPLES

Example 1

In order to show the improvement in tear strength by including a non-abrasive filler in the silicone base coating composition the following samples were prepared. To 100 parts of vinyl chainstopped polydimethylsiloxane having a viscosity of 3500 centipoise at 25° C. there was added 40 parts of the indicated non-abrasive fillers. Also contained therein was 20 ppm platinum in the form of platinum octanol complex and linear hydride cross-linking agent. This base silicone coating composition was coated and cured on fiberglass base fabric material, and the tear strength of the coated fabric determined by the trapezoid method. The construction of this glass fabric was DE-75, 2/2, 24×19 plain weave. The coatings were cured in an air circulating oven for 15 minutes at 300° F. The results are set forth in Table I.

TABLE I

Tear Strength of Coated Fabric
Trapezoid Method, Federal Test Material
Std. No. 191-Method 5136

| Sample | Filler | Tear Strength (lbs.) |
|---|---|---|
| 1 | None | 50 |
| 2 | Ground quartz | 35–45 |
| 3 | Calcium carbonate | 90–110 |
| 4 | Hydrated alumina | 100–150 |

EXAMPLE 2

In this example the improvement in tear strength provided by the present invention is illustrated with a 5 mil heat cleaned glass cloth having a fine, 112 electrical grade tight weave. In the present example the base fabric material had a trapezoidal tear strength of 5 pounds. Samples of the glass cloth coated with the base coating composition of Example 1 and RTV-668, respectively, and having ground quartz as a filler each had a tear strength of 2 to 3 pounds. Samples which utilized calcium carbonate or hydrated alumina as a non-abrasive filler in accordance with the present invention each had a tear strength of 8 to 9 pounds. When treated fumed silica was employed as a non-abrasive filler the base fabric material exhibited a tear strength of 7 to 15 pounds.

(RTV 668 is described in Table I, Example No. 3 of U.S. Pat. No. 3,436,366.)

TABLE II

| Sample | Base Coating | Filler | Tear Strength (lbs.) |
|---|---|---|---|
| Glass Cloth | None | None | 5 |
| 1 | As in Ex. 1 | Ground quartz | 2–3 |
| 2 | RTV-668 | Ground quartz | 2–3 |
| 3 | As in Ex. 1 | Calcium carbonate | 8–9 |
| 4 | As in Ex. 1 | Hydrated alumina | 8–9 |
| 5 | As in Ex. 1 | Hexamethyl disilazane treated fumed silica | 7–15 |

EXAMPLE 3

In order to show the improved flame retardance of the present invention the following samples were prepared with the results set out in Table III. A one-half inch by six inch piece of fiberglass fabric described in Example 2 above was coated as in Example 1. In the first sample the base polymer composition included 40 parts ground quartz filler, in the second sample 40 parts of calcium carbonate were included, and in the third sample 40 parts of hydrated alumina were added. The cured fabric membrane material was ignited, and the amount of the material consumed as well as the flame-glow time were measured.

The test used to determine the flammability of these materials consisted of having the 0.5"×6" sample of the material under test in a glass tube (2"ID×6" long). A bunsen burner with a 1.5 inch high soft blue flame is placed so that the lower 0.75" of the test specimen is in the center of the flame. After the flame has been applied for 20 seconds, the burner is removed and the duration of burnings is timed. The percent of the sample consumed and burning (glowing) time in seconds is recorded.

TABLE III

| Sample | Filler | % Consumed | Flame-Glow Time (sec.) |
|---|---|---|---|
| 1 | Ground quartz | 100 | 90 |
| 2 | Calcium carbonate | 20 | 25 |
| 3 | Hydrated alumina | 25 | 43 |

Thus it can be seen that the inclusion of a non-abrasive filler in the base silicone coating composition significantly improves the flame retardance of the base fabric material.

I claim:

1. A method for imparting improved tear strength and improved flame retardance to a base fabric material comprising (1) applying to at least one side of said base fabric material an addition curable base elastomeric silicone coating composition containing an effective amount of non-abrasive filler selected from the group consisting of calcium carbonate, hydrated alumina, fumed silica, aluminum silicate, potassium titanate, zirconium silicate, carbon black, zinc oxide, titanium dioxide, ferric oxide, silica aerogel, precipitated silica, calcium silicate, chromic oxide, cadmium sulfide, lithopone, talc, magnesium oxide and graphite, and mixtures thereof, and (2) applying to at least one side of said base fabric material coated with said base silicone coating composition a coating composition which is resistant to dirt pickup.

2. The method of claim 1 wherein the base fabric material is made of a material selected from the group consisting of cotton, polyester, nylon and glass fabric.

3. The method of claim 1 wherein the base fabric material is glass fabric.

4. The method of claim 1 wherein the base fabric material is selected from the group consisting of laminated and reinforced plastics.

5. The method of claim 1 wherein the base fabric material is fiberglass fabric.

6. The method of claim 1 wherein the base elastomeric silicone coating composition is translucent.

7. The method of claim 1 wherein the amount of non-abrasive filler ranges from 5 to 300 parts by weight per 100 parts by weight polymer in the base elastomeric silicone coating composition.

8. The method of claim 1 wherein the amount of non-abrasive filler ranges from 20 to 100 parts by weight per 100 parts by weight polymer in the base elastomeric silicone coating composition.

9. The method of claim 1 wherein the amount of non-abrasive filler ranges from 50 to 100 parts by weight per 100 parts by weight polymer in the base elastomeric silicone coating composition.

10. The method of claim 1 wherein the non-abrasive filler is selected from the group consisting of calcium carbonate, hydrated alumina and fumed silica.

11. The method of claim 1 wherein the dirt resistant coating composition comprises:

(a) a liquid vinyl chainstopped polysiloxane having the formula,

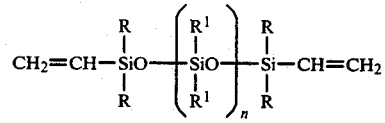

where R and $R^1$ are monovalent hydrocarbon radicals free of aliphatic unsaturation with at least 50 mole percent of the $R^1$ groups being methyl, and where n has a value sufficient to provide a viscosity of up to 500 centipoise at 25° C.;

(b) a resinous organopolysiloxane copolymer comprising $(R^2)_3SiO_{0.5}$ units and $SiO_2$ units, where $R^2$ is selected from the group consisting of vinyl radicals and monovalent hydrocarbon radicals free of aliphatic unsaturation, where the ratio of $(R^2)_3SiO_{0.5}$ units to $SiO_2$ units is from about 0.5:1 to about 1:1, and where from about 1.5 to about 10 mole percent of the silicon atoms contain silicon-bonded vinyl groups;

(c) a platinum catalyst; and (d) a liquid organohydrogenpolysiloxane having the formula, $$(R)_a(H)_bSiO_{\frac{4-a-b}{2}}$$

sufficient to provide from about 0.5 to about 1.0 silicon-bonded hydrogen atoms per silicon-bonded vinyl group, where R is as previously defined, a has a value of from about 1.0 to about 2.1, b has a value of from about 0.1 to about 1.0, and the sum of a and b is from about 2.0 to about 2.7, there being at least two silicon-bonded hydrogen atoms per molecule.

12. The method of claim 1 wherein the dirt resistant coating comprises:

(a) a liquid vinyl chainstopped polysiloxane having the formula,

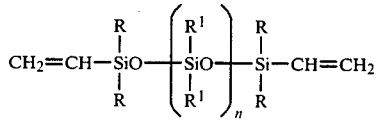

where R and $R^1$ are monovalent hydrocarbon radicals free of aliphatic unsaturation with at least 50 mole percent of the $R^1$ groups being methyl, and where n is sufficient to provide a viscosity up to 1,000 centipoise at 25° C.;

(b) a resinous organopolysiloxane copolymer comprising $(R^3)_3SiO_{0.5}$ units, $(R^3)_2SiO$ units and $SiO_2$ units, where $R^3$ is selected from the group consisting of vinyl radicals and monovalent hydrocarbon radicals free of aliphatic unsaturation, where from about 1.5 to about 10 mole percent of the silicon atoms contain silicon-bonded vinyl groups, and where the ratio of $(R^3)_3SiO_{0.5}$ units to $SiO_2$ units is from about 0.5:1 to about 1:1 and the ratio of $(R^3)_2SiO$ units to $SiO_2$ units may range up to 0.1:1;

(c) a platinum catalyst; and (d) a liquid organohydrogenpolysiloxane having the formula, $$(R)_a(H)_bSiO_{\frac{4-a-b}{2}}$$

sufficient to provide from about 0.5 to about 1.0 silicon-bonded hydrogen atoms per silicon-bonded vinyl group, where R is as previously defined, a has a value of from about 1.0 to about 2.1, b has a value of from about 0.1 to about 1.0, and the sum of a and b is from about 2.0 to about 2.7, there being at least two silicon-bonded hydrogen atoms per molecule.

13. The method of claim 1 wherein the dirt resistant coating comprises:

(a) 100 parts of a liquid vinyl chainstopped polysiloxane having the formula,

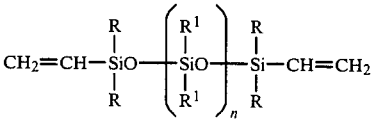

where R and $R^1$ are monovalent hydrocarbon radicals free of aliphatic unsaturation with at least 50 mole percent of the $R^1$ groups being methyl, and where n has a value sufficient to provide a viscosity of up to about 2,000,000 centipoise at 25° C.;

(b) 100–200 parts of a resinous organopolysiloxane copolymer selected from the group consisting of:

(i) resinous organopolysiloxane copolymer comprising $(R^2)_3SiO_{0.5}$ units and $SiO_2$ units, where $R^2$ is selected from the group consisting of vinyl radicals and monovalent hydrocarbon radicals free of aliphatic unsaturation, where the ratio of $(R^2)_3SiO_{0.5}$ units to $SiO_2$ units is from about 0.5:1 to about 1:1, and where from about 1.5 to about 10 mole percent of the silicon atoms contain silicon-bonded vinyl groups; and (ii) resinous organopolysiloxane copolymers comprising $(R^3)_3SiO_{0.5}$ units, $(R^3)_2SiO$ units and $SiO_2$ units, where $R^3$ is selected from the group consisting of vinyl radicals and monovalent hydrocarbon radicals free of aliphatic unsaturation, where from about 1.5 to about 10 mole percent of the silicon atoms contain silicon-bonded vinyl groups, and where the ratio of $(R^3)_3SiO_{0.5}$ units to $SiO_2$ units is from about 0.5:1 to about 1:1 and the ratio of $(R^3)_2SiO$ units to $SiO_2$ units may range up to 0.1:1;

(c) a platinum catalyst; and (d) a liquid organohydrogenopolysiloxane having the formula, $$(R)_a(H)_bSiO_{\frac{4-a-b}{2}}$$

sufficient to provide from about 0.5 to about 1.0 silicon-bonded hydrogen atoms per silicon-bonded vinyl group, where R is as previously defined, a has a value of from about 1.0 to about 2.1, b has a value of from about 0.1 to about 1.0, and the sum of a and b is from about 2.0 to about 2.7, there being at least two silicon-bonded hydrogen atoms per molecule.

14. A method for imparting improved tear strength and improved flame retardance to a base fabric material comprising applying to at least one side of a base fabric material selected from the group consisting of cotton, polyester, nylon, glass fabric, laminated plastics and reinforced plastics a base elastomeric silicone coating composition containing from 5 to 300 parts by weight of a non-abrasive filler selected from the group consisting of calcium carbonate, hydrated alumina, fumed silica, aluminum silicate, potassium titanate, zirconium silicate, carbon black, zinc oxide, titanium dioxide, ferric oxide, silica aerogel, precipitated silica, calcium silicate, chromic oxide, cadmium sulfide, lkthopone, talc, magnesium oxide and graphite and mixtures thereof, and, applying to at least one side of said base fabric material coated with said base silicone coating composition, a coating composition which is resistant to dirt pickup.

15. The method of claim 14 wherein the base fabric material is fiberglass cloth and the elastomeric silicone coating composition contains from 20 to 100 parts by weight per 100 parts by weight polymer in the base base elastomeric silicone coating composition of non-abrasive filler selected from the group consisting of calcium carbonate, hydrated alumina and fumed silica.

16. An article useful as a roofing fabric membrane structure having improved tear strength and flame retardance comprising:

(a) a base fabric material;

(b) an addition curable elastomeric silicone base coating composition having an effective amount of non-abrasive filler selected from the group consisting of calcium carbonate, hydrated alumina, fumed silica, aluminum silicate, potassium titanate, zirconium silicate, carbon black, zinc oxide, titanium dioxide, ferric oxide, silica aerogel, precipitated silica, calcium silicate, chromic oxide, cadmium sulfide, lithopone, talc, magnesium oxide and graphite, and mixtures thereof applied to at least one side of said base fabric material; and (c) a coating composition which is resistant to dirt pickup on at least onse side of said base fabric material.

17. The article of claim 16 wherein the base fabric material is selected from the group consisting of cotton, polyester, nylon, glass fabric, laminated plastics and reinforced plastics.

18. The article of claim 16 wherein the base fabric material is fiberglass fabric.

19. The article of claim 16 wherein the base elastomeric coating composition is a translucent or transparent silicone composition.

20. The article of claim 16 wherein the amount of non-abrasive filler ranges from 5 to 300 parts by weight per 100 parts by weight polymer in the base elastomeric silicone coating composition.

21. The article of claim 16 wherein the amount of non-abrasive filler ranges from 20 to 100 parts by weight per 100 parts by weight polymer in the base elastomeric silicone coating composition.

22. The article of claim 16 wherein the non-abrasive filler is selected from the group consisting of calcium carbonate, hydrated alumina and fumed silica.

* * * * *